US006866579B2

(12) United States Patent
Pilger

(10) Patent No.: US 6,866,579 B2
(45) Date of Patent: Mar. 15, 2005

(54) BOOT HANGER MOUNTING BRACKET

(75) Inventor: Allan Pilger, Longview, WA (US)

(73) Assignee: Applied Applications International, Inc., Longview, WA (US)

( * ) Notice: Subject to any disclaimer, the term of this patent is extended or adjusted under 35 U.S.C. 154(b) by 96 days.

(21) Appl. No.: 10/194,570

(22) Filed: Jul. 11, 2002

(65) Prior Publication Data

US 2004/0185772 A1 Sep. 23, 2004

(51) Int. Cl.[7] ..... F24F 7/04
(52) U.S. Cl. ..... 454/292
(58) Field of Search ..... 454/330, 331, 454/292; 52/220.1, 302.1

(56) References Cited

U.S. PATENT DOCUMENTS

| | | | | | |
|---|---|---|---|---|---|
| 465,561 | A | * | 12/1891 | Hood | 454/330 |
| 943,298 | A | | 12/1909 | Brown | |
| 1,690,948 | A | | 11/1928 | Rote | |
| 2,679,796 | A | * | 6/1954 | Froelich et al. | 454/331 |
| 3,238,860 | A | | 3/1966 | O'Day et al. | 98/40 |
| 3,645,044 | A | | 2/1972 | Akre | 49/465 |
| 3,888,013 | A | | 6/1975 | Benoit | 33/174 |
| 3,955,483 | A | | 5/1976 | Sunter | 98/114 |
| 4,372,763 | A | | 2/1983 | Champlin et al. | 55/501 |
| 4,377,107 | A | | 3/1983 | Izumi | 98/40 |
| 4,558,582 | A | | 12/1985 | Meinig | 72/381 |
| 4,815,364 | A | * | 3/1989 | Wagner et al. | 454/318 |
| 5,338,255 | A | * | 8/1994 | Akehurst | 454/292 |
| 5,338,256 | A | * | 8/1994 | Tonna | 454/310 |
| 5,476,183 | A | | 12/1995 | Harpenau | 220/3.3 |
| 5,716,270 | A | | 2/1998 | Chambers | 454/332 |
| 5,741,030 | A | | 4/1998 | Moore et al. | 285/23 |
| 5,792,230 | A | | 8/1998 | Moore et al. | 55/493 |
| 6,192,640 | B1 | | 2/2001 | Snyder | 52/302.1 |
| RE37,086 | E | | 3/2001 | Moore et al. | 454/330 |
| 6,234,894 | B1 | | 5/2001 | Goracke et al. | 454/290 |
| 6,302,784 | B1 | * | 10/2001 | Berger | 454/289 |

* cited by examiner

*Primary Examiner*—Gregory A. Wilson
(74) *Attorney, Agent, or Firm*—Cislo & Thomas LLP

(57) ABSTRACT

The present invention relates to duct systems, registers and ductwork components used with floor or ceiling registers employed in warm air heating, ventilating and air conditioning systems, and specifically to improvements for mounting and installing the components of the duct system, including register boots, mud rings and register grilles, in the walls, floors or ceilings of buildings.

The invention includes an adjustable boot hanger mounting bracket assembly comprising a boot hanger frame portion and a support member portion; the ductwork components, which may include a pre-fabricated can-boot/mud ring assembly; a pair of boot hanger arms; and a register grille. The boot hanger mounting bracket assembly is formed of a sturdy yet bendable material so that it can be configured and adjusted on-site. Once configured, the boot hanger mounting bracket assembly is secured to the building structure by securing a pair of boot hanger arms to the ceiling joists, wall studs or other support structure. In this way, the boot hanger mounting bracket, through a direct attachment to the ceiling joist or wall stud, provides a positive inexpensive simple and error free way to mount the duct components.

18 Claims, 12 Drawing Sheets

BOOT HANGER MOUNTING BRACKET

BACKGROUND OF THE INVENTION

1. Field of the Invention

This invention relates to duct systems, registers and register boots, used as air ducts for warm air heating, ventilating and air conditioning systems, and specifically to improvements for mounting and installing the components of the duct system, including register boots, mud rings and air registers, in the walls, floors or ceilings of buildings.

2. Description of the Related Art

Forced air heating, cooling and ventilation systems, or "HVAC systems" are designed to provide control of space temperature, humidity, air contamination, differential pressurization, and air motion. These distribution systems use a network of ducts to deliver the heated and/or cooled air to the various rooms and spaces within a building structure. Of the many HVAC systems currently available, galvanized sheet steel duct systems are among the most widely used. These systems generally consist of an air heating and/or refrigeration unit, straight sections of duct, and multiple types of fabricated fittings and connections. From these fittings and connections, the straight sections of duct are connected to each other and to openings or vents in the rooms and spaces of the building structure. Currently, the ductwork connections and fittings are fabricated primarily by experienced sheet metal workers.

Where the ducts are accurately sized and the duct system is correctly designed, the air will be delivered to the rooms and spaces with a minimum of resistance. In HVAC systems, the ductwork interfaces with the room through one or more open-end duct portions. Generally, a grille or louver is mounted on the interfacing end of the duct to face into the room. Because the grilles generally must be mounted to the wall studs or ceiling joists, or to the ducts themselves, there is a risk that the grilles may be insecurely mounted or mounted at odd angles, particularly where the grilles are first attached and subsequently temporarily removed for wall painting or cleaning or other purposes.

Several considerations regarding the design of the connections and fittings used in HVAC systems are important. First, the connections and fittings are difficult to store, handle, and transport without incurring damage. In addition, due to their shape and design, they require a large quantity of space per unit to store and transport. These problems cause the production of excessive scrap and increased inventory holding and transportation costs for the distributor and customers.

Additionally, the configuration of the ductwork and grilles poses a problem for unskilled construction workers and is extremely time consuming. Generally, this work involves fitting together preformed components that frequently differ in dimensions and require careful measuring and positioning during the installation process so that the components fit together and so that no gaps are created. For example, a worker will commonly transpose the dimensions of the grille register onto the area of the wall or ceiling opening to ascertain the dimensions of the opening to be cut; or alternately he will select a standard size commercially available register grille to fit into a pre-existing opening. Because any measurements can introduce inaccuracies, the possibility that the components will not fit together or provide support for the grille register and boot in the wall or ceiling opening or create gaps between the edges of the opening and the grille register is a real concern. In these cases, another bracket must be brought to the site and used, or the grille opening must be modified or the grille register replaced with a different size so that the components fit together and so that the register and boot are securely supported in the opening in the wall or ceiling.

In light of the problems noted above and in an attempt to speed up the installation process and avoid waste of materials, new installation methods and devices have been sought. The present invention allows for easy transportation, storage and on-site installation while providing an adjustable assembly that provides solid backing for mounting the ductwork components.

SUMMARY OF THE INVENTION

It is an object of the present invention to overcome the above and other drawbacks by providing an assembly to support and mount ductwork components of heating, cooling and ventilation systems. The assembly has a simple and versatile construction and can be quickly and easily assembled. Further, the assembly may be stored and transported in a flattened state, and can be adjusted on-site to provide an accurate fit between the boot register, grille and wall, floor or ceiling opening, which reduces costs.

Generally, the invention includes a boot hanger mounting bracket assembly comprising an adjustable boot hanger frame portion and a support member portion; ductwork components such as a can-boot and mud ring that may be prefabricated; a pair of boot hanger arms; and an airflow control means, such as a register grille. The boot hanger mounting bracket assembly is configured so that the boot hanger frame portion preferably sits in a concentric fashion about the support member portion and comprises two pairs of parallel rearward projecting flanges along its sides. Alternately, the boot hanger mounting bracket assembly may be formed from a single piece of material or as a single unit, in which case the support member portion preferably is disposed along the inner perimeter of the boot hanger frame portion. A tabbed or lip portion of the support member portion is preferably configured at a right angle to the sidewalls of the support member so that the lip portion may lie flush against the rear surface of the boot hanger frame portion along its inner perimeter. The lip portion is preferably secured to the boot hanger frame portion by a securing material such as spot welds, button punches, epoxy or riveting. The boot hanger frame portion and support member portion are preferably configured so that a portion of the support member projects beyond the front face of the boot hanger frame to receive the airflow control means. The boot hanger frame portion is preferably formed from pairs of parallel strips so that it may be preformed or configured on-site by adjusting to the proper size and securing at the corners with a securing material, such as spot welds, button punches, epoxy or riveting. Likewise, the support member, or the entire device if formed as a single unit, may be preformed or may be transported in a flattened state to the site so that the boot hanger mounting bracket assembly can be configured on-site to interface with the particular ductwork components, such as can-boot, and register grilles. The support member portion may be formed of a sturdy yet bendable material so that it can folded on-site to form a pocket, into which the edge of the boot or other duct work component sits, and to form the lip portion, which is preferably secured to the boot hanger fame portion. The finished boot hanger mounting bracket assembly may then be secured to the building structure by securing the boot hanger arms to the boot hanger frame portion and to the ceiling joists, wall studs or other structure. In this way, the boot hanger mounting bracket assembly, through a direct attachment to the ceiling joist or wall stud, provides a positive inexpensive simple and error free way to mount the duct components.

OBJECTS OF THE INVENTION

It is an object of the present invention to provide a pre-assembled mounting bracket to support a register-grille and ductwork assembly.

It is a further object of the present invention to provide a pre-fabricated or pre-assembled can-boot and mud ring assembly to be used in commercial and residential HVAC applications.

It is another object of the present invention to provide an adjustable or "fit-to-size" mounting assembly for easy and accurate installation of ductwork components such as can-boots and register grilles.

It is yet another object of the present invention to provide a support and solid backing for mounting ductwork components such as can-boots and register grilles.

Another object of the invention is to provide a secure connection between building studding or ceiling joists and the mounting bracket, register and duct work components, such as can-boots.

A further object of this invention is to provide a mounting means that can be used when there are slight variations in the dimensions of the wall or ceiling opening or in the fit between the register grille and opening, and which does not require the use of spring-pressured mounting means or clips that must be affixed to the sheet rock or the like, so that the risk of deformation or damage of the ceiling or wall or ductwork is minimized.

It is a further object of the invention to provide an improved mounting bracket that may be formed from an inexpensive blank of foldable sheet material and may be effectively compressed together to form a compact bundle for shipment, transport to the installation site or for storage.

It is a further object of the invention to provide an improved mounting bracket having a sturdy connection to the building structure on which a register grille and ductwork components, such as a can-boot, is mounted and which provides minimum obstruction of the airflow through the associated ductwork.

It is a further object of the invention to produce a mounting bracket that allows adjustable installation and allows the register grille to be placed in close proximate fit to both the ductwork and the ceiling or wall in which the register grille is installed so that gaps may be minimized.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
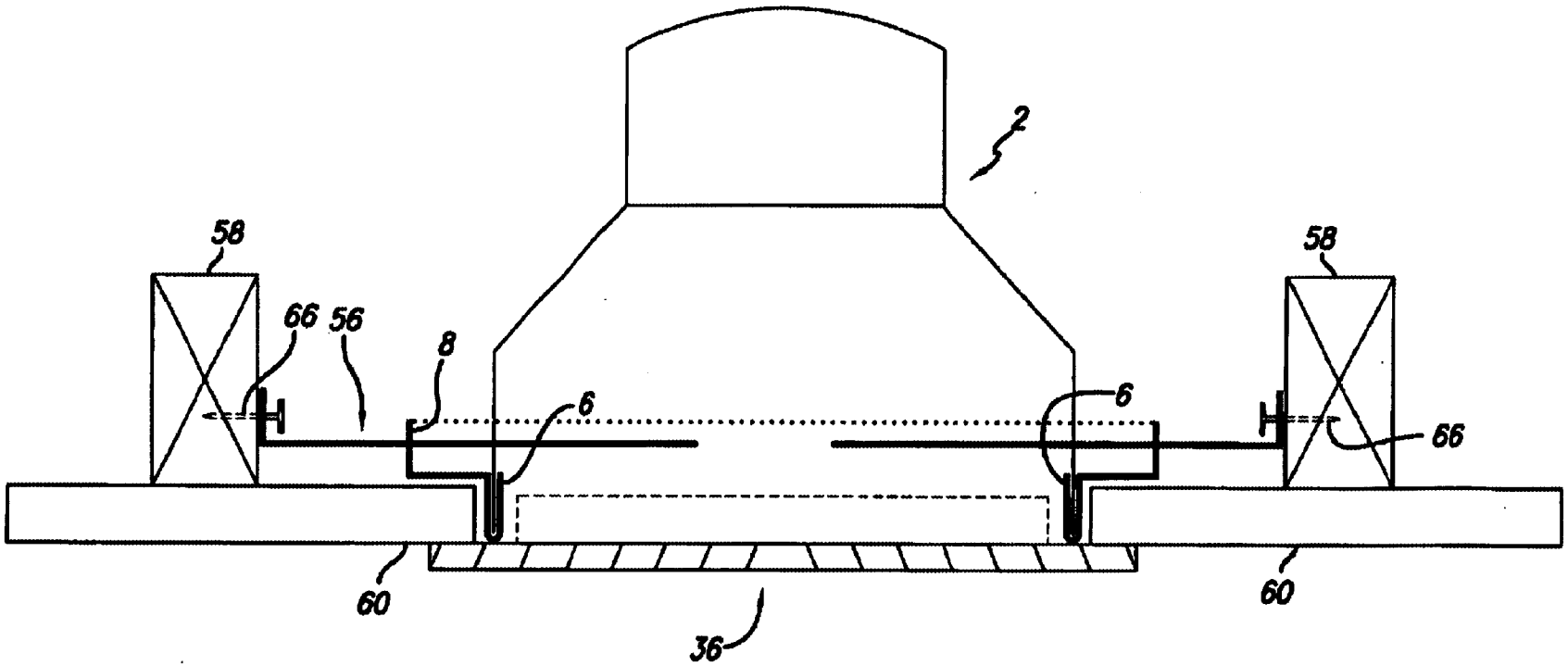
FIG. 1 is a cutaway side view of the present invention mounted in a structure between two ceiling joists.

Turning now to FIGS. 1 to 13 of the drawings, and more particularly to FIG. 1, the typical environment which the present invention is operated is illustrated. As shown in FIG. 1, a typical vertical ceiling joist 58 is shown. Although FIG. 1 illustrates the present invention mounted in a ceiling, it is contemplated that the present invention may be mounted within the floor, wall or ceiling of a room. Attached to the ceiling joist 58 is a ceiling lid 60 formed from materials such as dry wall or sheet rock. FIG. 1 also shows an airflow control means 36, such as an air register grill or louver, mounted within the ceiling of a room.

Figure 2:
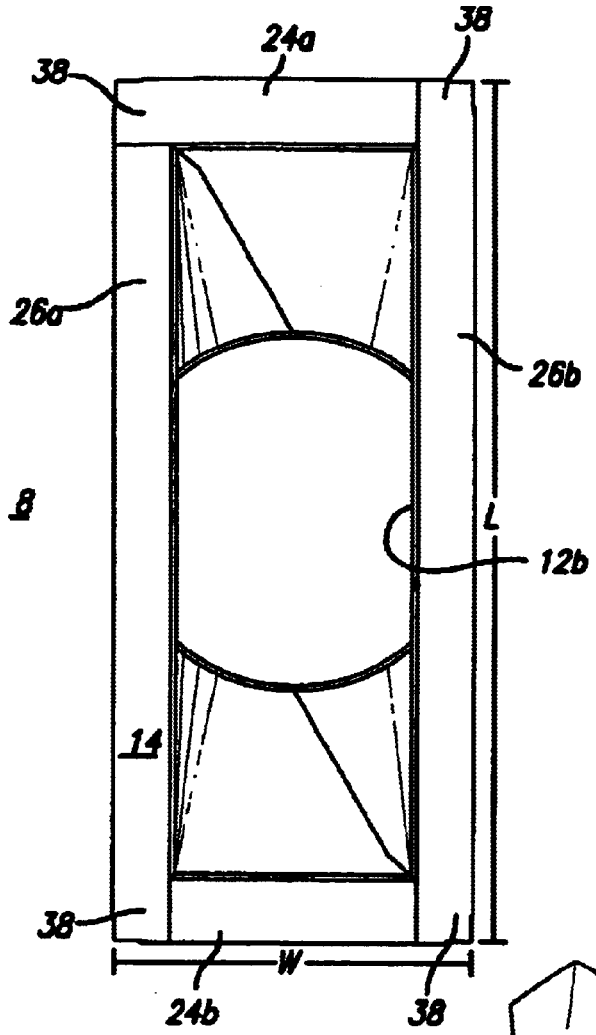
FIG. 2 is a front plan view of the boot hanger frame portion and interior of the can-boot and mud ring components of the ductwork.
Figure 3:
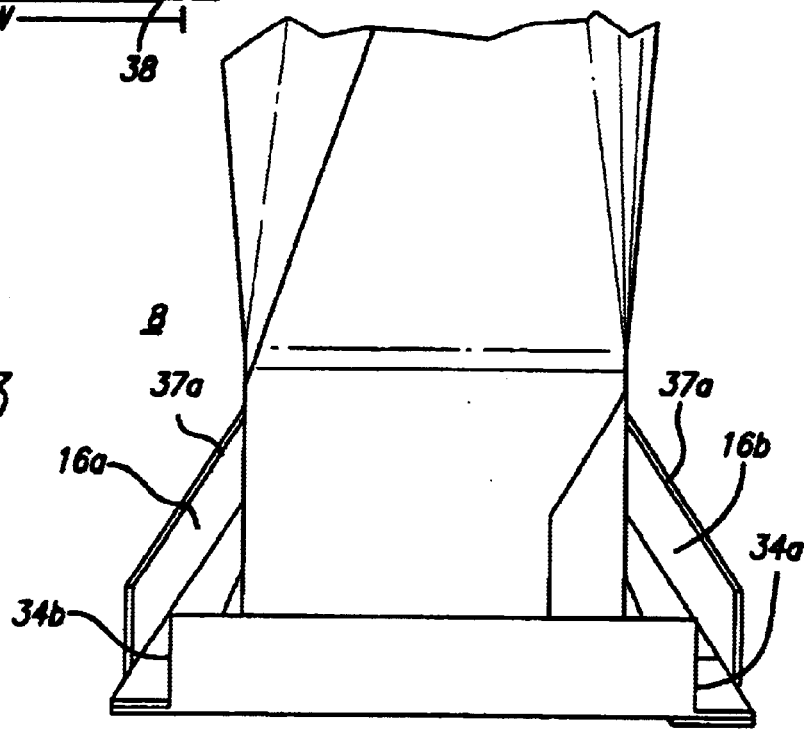
FIG. 3 is a close-up side view of the hanger frame flanges and can-boot component of the ductwork.
Figure 4:
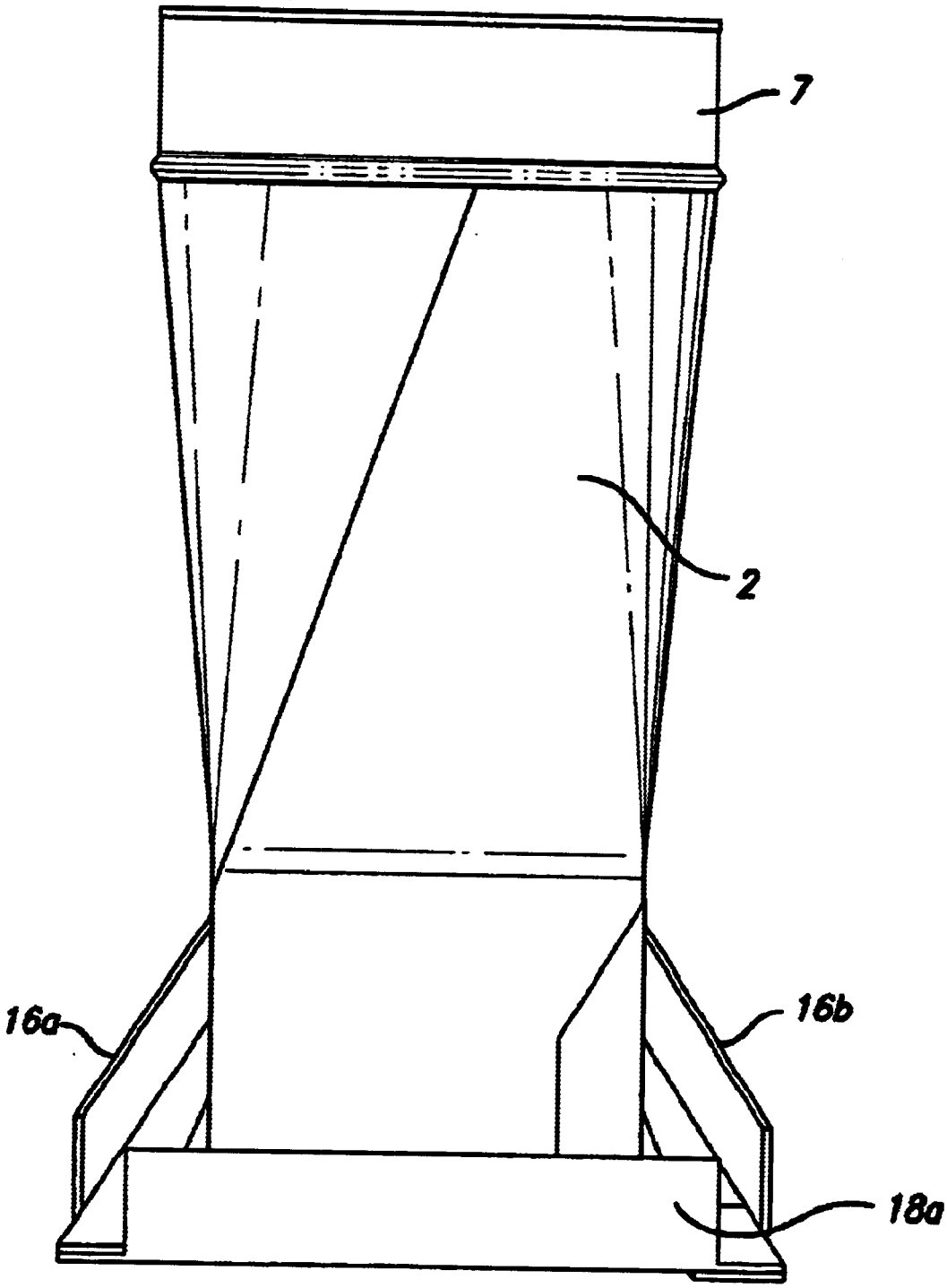
FIG. 4 is a side view of the hanger frame flanges and can-boot component of the ductwork.
Figure 5:
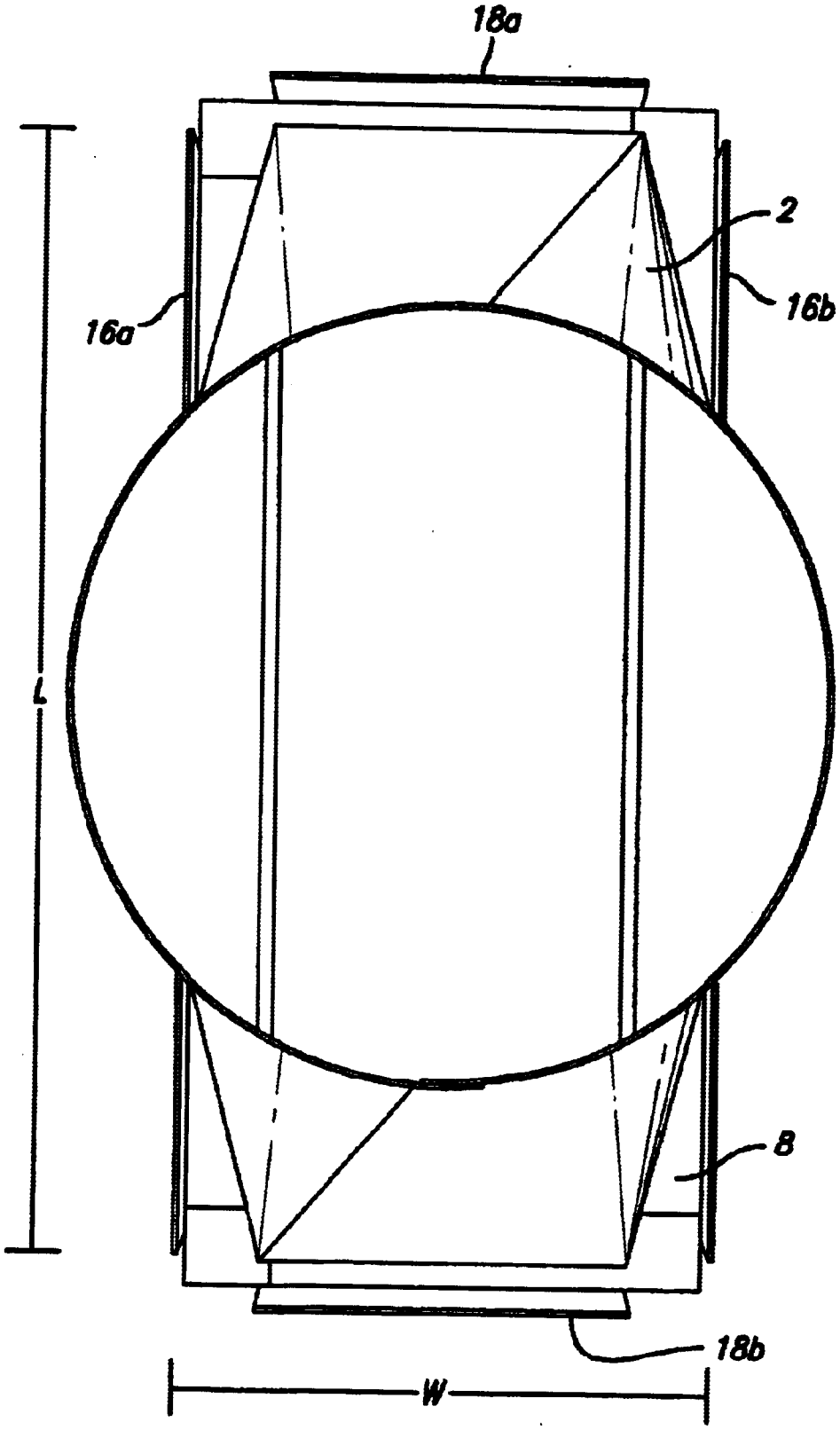
FIG. 5 is a top plan view of a mud ring, can-boot and boot hanger frame portion.
Figure 6:
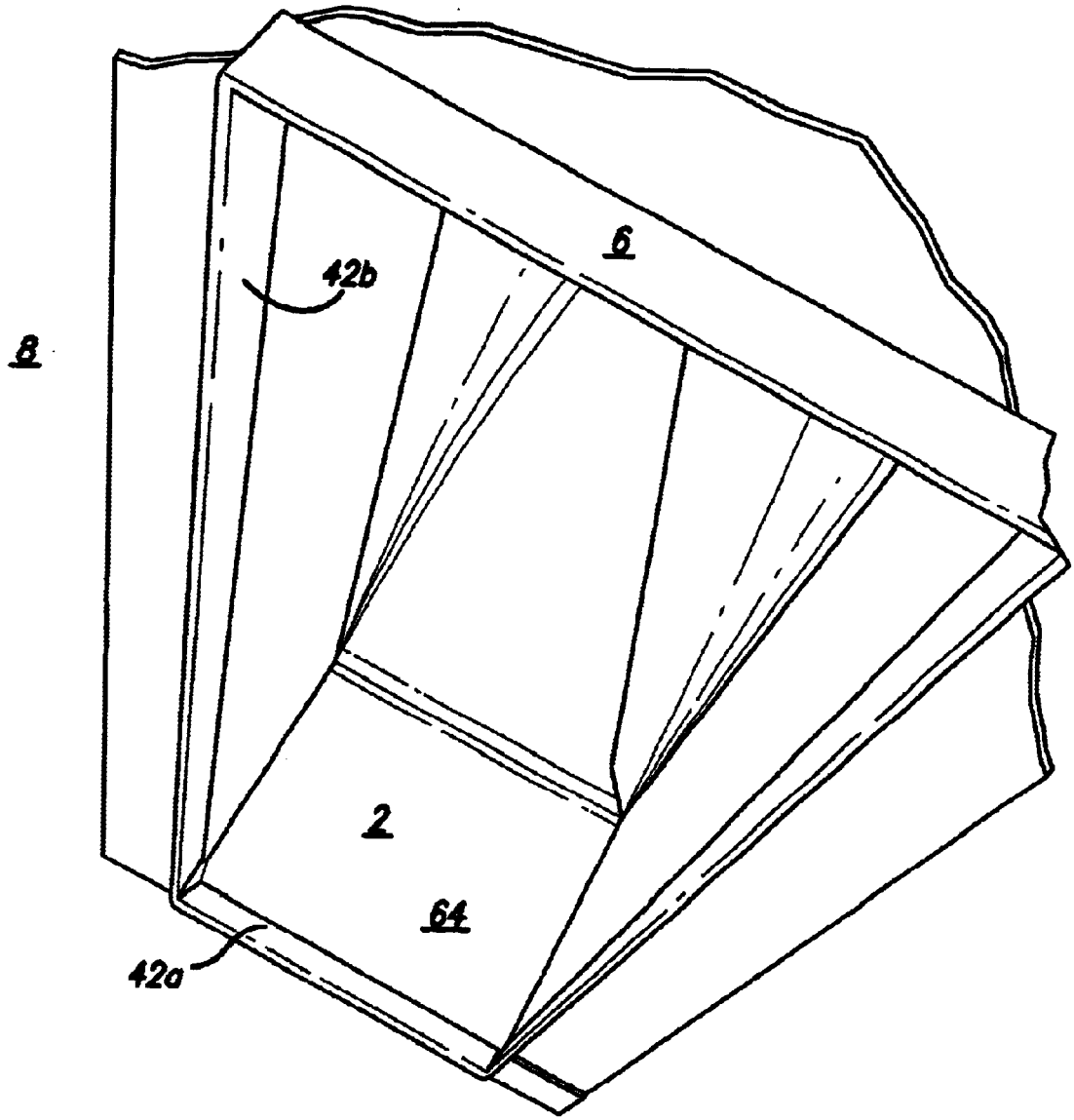
FIG. 6 is a perspective bottom view of the present invention showing the interior of the can-boot, the interface of the can-boot edges and the support member portion and the boot hanger frame portion.

The present invention generally comprises pre-fabricated ductwork components such as a can-boot 2, mud ring 7, a support member portion 6, a boot hanger frame portion 8, and a pair of boot hanger arms 56. The present invention contemplates that the can-boot or other ductwork component 2 and mud ring 7 may be pre-fabricated and fit together prior to arriving at the work site, or alternately, semi-fabricated and configured at the site. An airflow control means 36 may be included and may comprise a commercially available standard register grille or grilles. The boot hanger arms 56 may be mounted to the ceiling joists 58 by fastening member such as nails or screws. It is contemplated that the invention will be disposed within an opening that is in communication with the ductwork of a central heating or cooling system or a ventilation system (not shown) of a structure and that the support member 6 defines an opening 12*a* sized to fit the airflow control means 36. The support member portion 6 and the boot hanger frame portion 8 each have length, l dimension and width dimension, w, and when fitted together, define opening 12*b* (FIG. 2). Alternately, the support member portion 6 and the boot hanger frame portion 8 are formed from a single piece of material, or pre-formed as a single unit. The size of the opening 12*b* may vary to fit most residential and commercial HVAC needs and grille or register sizes. For example, in a first embodiment, the boot hanger frame portion 8 and support member portion 6 are configured to form a boot hanger mounting bracket assembly having an opening 12*b* of approximately 31 cm in length by approximately 10 cm in width. Examples II, and III, herein illustrate without limitation other suitable dimensions.

Referring to FIGS. 2–5, the boot hanger frame portion 8 comprises a planar front surface 14 defining an opening and two pairs of parallel rearward projecting flanges 16*a*, 16*b*, 18*a*, 18*b* along, respectively its length, l, and width, w. Each flange comprises a pair of parallel edges 34*a*, 34*b* and a rear edge 36*a*. The flanges preferably serve to stabilize the position of the hanger arms 56 in relation to the boot hanger frame portion 8 and other components. The boot hanger frame portion 8 is preferably formed by two sets of parallel, galvanized metal strips 26*a*, 26*b* and 24*a*, 24*b* forming respectively, the length, l, and width, w, of the boot hanger frame portion 8. It is contemplated that the present invention may also be formed from a flat sheet of material by stamping and cutting. The strips or flat sheet may be formed from suitable materials comprising, for example, galvanized metals, aluminum, steel, high impact polystyrene or of resin formulations such as ABS resin.

Where the device is formed from a flat sheet of material, the flanges 16*a*, 16*b*, 18*a*, 18*b* may be formed by manual bending of pre-etched lines 90 or by use of a suitable metal working devices. Preferably, flanges 16*a*, 16*b*, 18*a*, 18*b* are shorter in length than the respective parallel strips 26*a*, 26*b*, 24*a* and 24*b* from which they project rearward. For example, in the first embodiment, the width of the boot hanger frame portion 8 is formed from parallel strips 24*a*, 24*b*, having a finished size of approximately 2.5 cm wide and 15 cm long with reward projecting flanges 16*a*, 16*b* that are approximately 12.5 cm long and 2.5 cm wide. In the first embodiment the length of the boot hanger frame portion 8 is formed from parallel strips 26*a*, 26*b*, that have a finished size of approximately 2.5 cm wide and 36 cm long and rearward projecting flanges 18*a*, 18*b* of approximately 33.0 cm long and 2.5 cm wide.

The boot hanger frame portion 8 may be formed by overlapping the parallel sets of metal strips 26*a*, 26*b* and 24*a*, 24*b*, so that an overlap portion 38 is formed at the interface of perpendicularly positioned sets of strips 24 and 26, which form the corners of the boot hanger frame portion 8. For example, in the first embodiment, the overlap portion 38 forms a square of approximately 2.5 cm by 2.5 cm at each corner of the boot hanger frame portion 8. Strips 24*a*, 24*b* and 26*a*, 26*b* are preferably secured to each other via a securing material 84, such as spot weld, button punches, rivets or epoxy, at the overlap portion 38. The boot hanger frame portion 8 may be pre-formed or the securing step may be carried out on-site so that the boot hanger frame portion 8 can be adjusted and sized on-site. In the first embodiment, the secured parallel strips 24*a*, 24*b* and 26*a*, 26*b* form a boot hanger frame portion 8 having an opening of approximately 10 cm wide by 35 cm long and having two pairs of rearward facing parallel flanges 16*a*, 16*b* and 18*a*, 18*b* of, respectively, approximately 2.5 cm wide by 12.5 cm long and 2.5 cm wide by 33.0 cm long.

Figure 7:
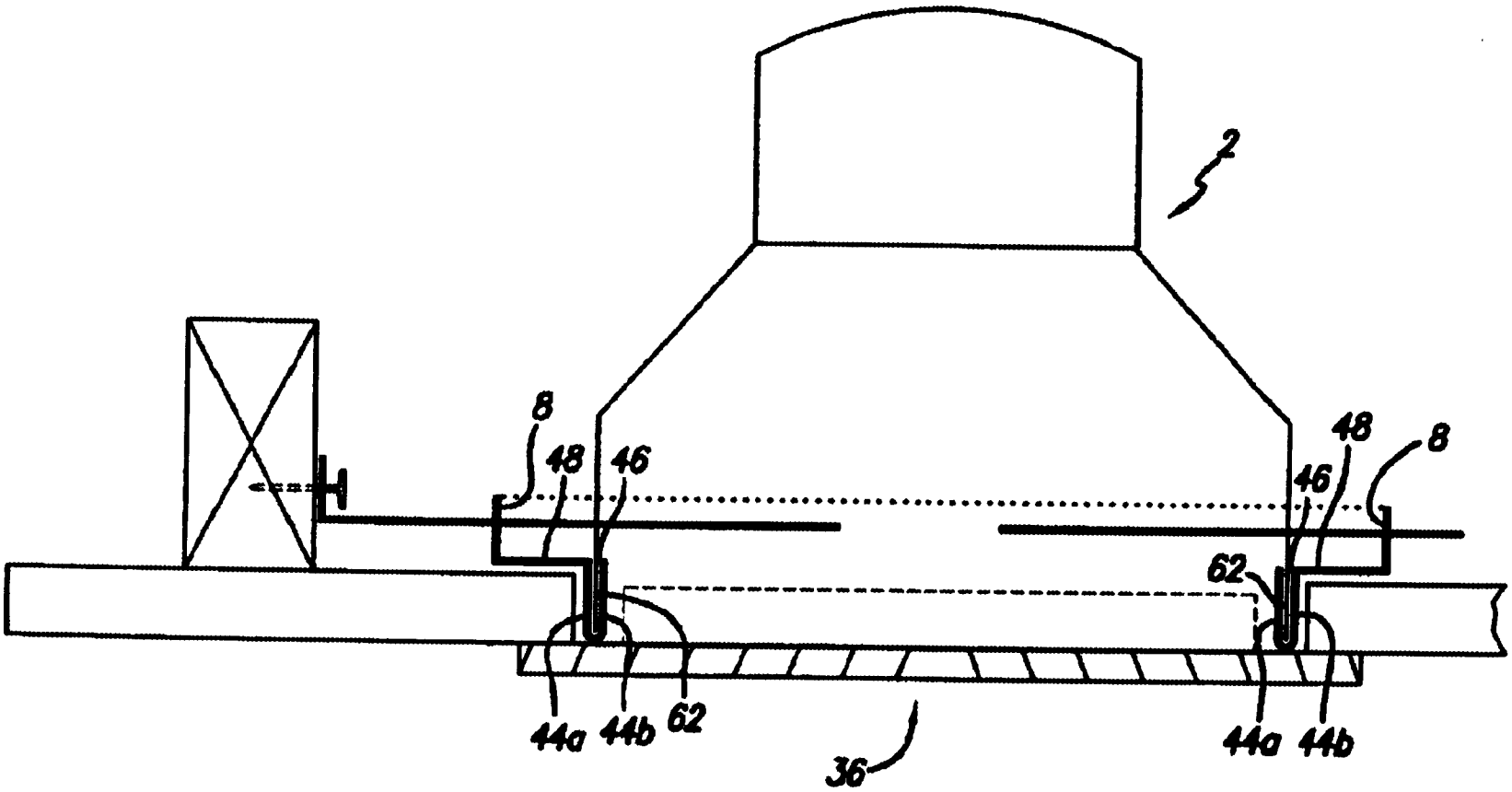
FIG. 7 is an enlarged cutaway side view of the present invention, as mounted between to the ceiling joists of a structure, showing the pockets defined by the sidewalls of the support member portion.
Figure 8:
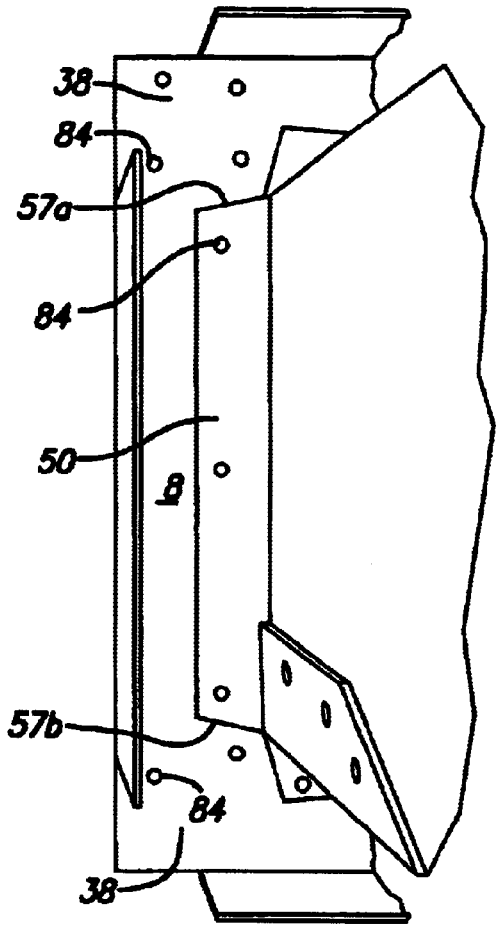
FIG. 8 is an enlarged top plan view of the interface of the support member portion and boot hanger frame portion and can-boot, showing attachment of the lip portion of the support member portion to the front surface of the boot hanger fame.
Figure 11:
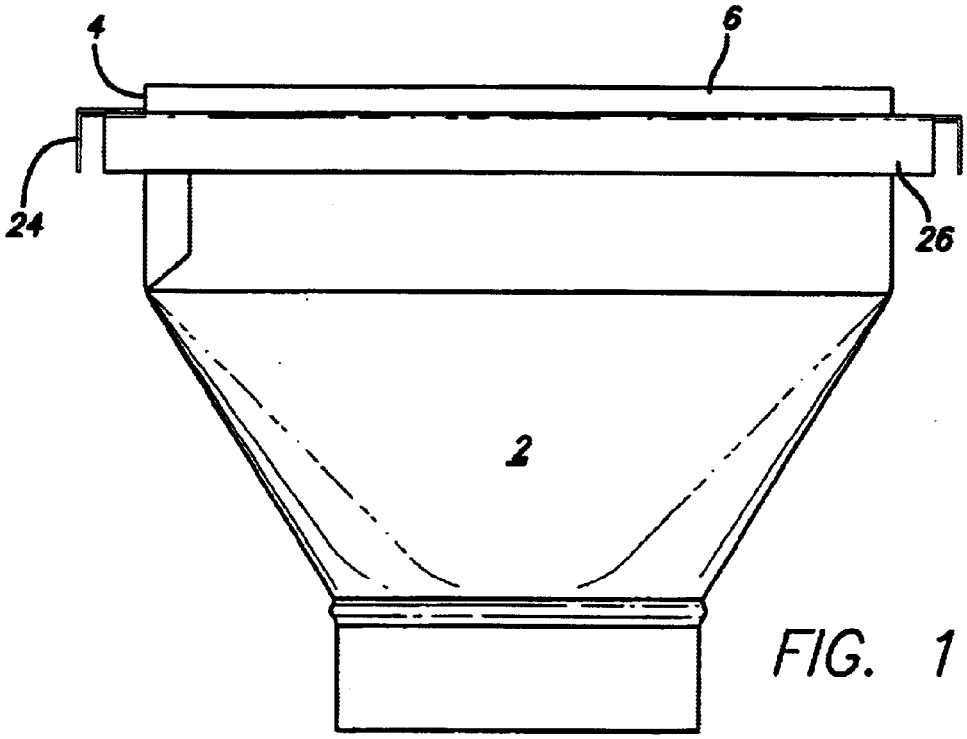
FIG. 11 is a side view of the mud ring, can-boot, boot hanger frame portion and support member portion.

The support member portion 6 is configured to receive a portion of the can-boot, or other ductwork component, 2 and to interface with the boot hanger frame portion 8. For example, in the first embodiment, the boot hanger support member portion 6 preferably has a finished length and width of, respectively; about 29.5 and about 9.5 cm to provide a good fit at the interface of the boot hanger frame portion 8 and the support member portion 6. Example I summarizes the dimensions of a first embodiment of the boot hanger frame portion 8 and support member 6. As shown in Examples II and III, however, the dimensions may vary according to the dimensions of the can-boot or other ductwork components 2 required and airflow control means 36. The support member portion 6 may be pre-formed or taken to the site in a flattened state for easy transport. If formed on-site, the sides and dimensions of the support member portion 6 may be formed by manually bending the sheet material from which the support member portion 6 is formed. The material may comprise etched or marked lines 90 to facilitate the bending and formation process. For example, in the first embodiment, the finished support member portion 6 comprises two sets of parallel sides 41*a*, 41*b* and 40*a*, 40*b* defining a central opening 12*a* and having an inner and an outer perimeter, and sidewalls defining a slot or "pocket". The edges of the inner and outer perimeter of the support member portion 6 form, respectively, inner tabs 42*a*, 42*b*, 42*c* 42*d* and outer tabs 48*a*, 48*b*, 48*c*, 48*d*. To form the support member portion 6 from a flat sheet of material, a first step comprises folding inner perimeter tabs 42*a*, 42*b*, 42*c* and 42*d* towards the central opening 12*a* and folding outer tabs 48*a*, 48*b*, 48*c*, 48*d* away from the central opening 12*a* to form two parallel sidewalls 44*a*, 44*b* defining a pocket 46 (FIG. 7). A second step comprises either forming the boot hanger frame portion 8 (where the device is formed as a single unit) or fitting the boot hanger frame portion 8 around the outer perimeter of the support member portion 6 and further bending the inner tabs 42*a*, 42*b*, 42*c*, 42*d* at approximate right angles to form a lip portion 50 on each side of the support member portion 6 (FIG. 8). The boot hanger frame portion 8 is preferably disposed about the support member portion 6 such that the part of the inner 42 and outer tabs 48 forming the parallel sidewalls 44*a*, 44*b* and pocket 46 project beyond the front surface of the boot hanger frame portion 8 (FIG. 8). In the first embodiment, the, folded inner 42 and outer 48 tabs forming the parallel sidewalls 44*a*, 44*b* and pocket 46 extend about 1.0 cm beyond the front face of the boot hanger frame portion 8. The lip portion 50 is preferably configured so that it lies flush against the back surface of the boot hanger frame portion 8 from its inner perimeter. For example, in the first embodiment, an inner tab 42 of approximately 1.0 cm in width and outer tab 48 of approximately 2.0 to 2.5 cm wide are folded respectively towards and away from the inside of the central opening 12*a* to form two parallel sidewalls 44*a*, 44*b* defining a pocket 46 of approximately 0.1 to 0.25 cm in width. All but approximately 1.0 cm of the outer tab 48 is then further folded over at a right angle to form the lip portion 50, which in the first embodiment is approximately 1.0 to 1.5 cm in width. In the first embodiment the bottom edges of the lip portion 50 along the length of the support member portion 6 are approximately 9.0 cm so that parallel side edges 56*a*, 56*b* may be angled inward (similar to an envelope flap) to provide a good fit at the corners of the boot hanger frame portion 8. The support member portion 6 can then be securely fastened to the boot hanger frame portion 8 by fastening the respective lip portion 50 to the surface of each of strips 24*a*, 24*b* an 26*a*, 26*b*. The front edges 62 of the can-boot or other ductwork component 2 may then be fit into the pocket 46 created by the folded inner 42 and outer tabs 48 before or after the lip portion 50 is formed. The material forming the support member portion 6 may then be pressed or otherwise adjusted to provide a snug fit between the support member portion 6 and can-boot or other ductwork component 2. The adjustment step may be performed prior to securing the lip portion 50 to the boot hanger frame portion 8 and/or prior to securing the folded inner tab 42 to the interior surface 64 of the can-boot or other ductwork component 2.

Figure 9A:
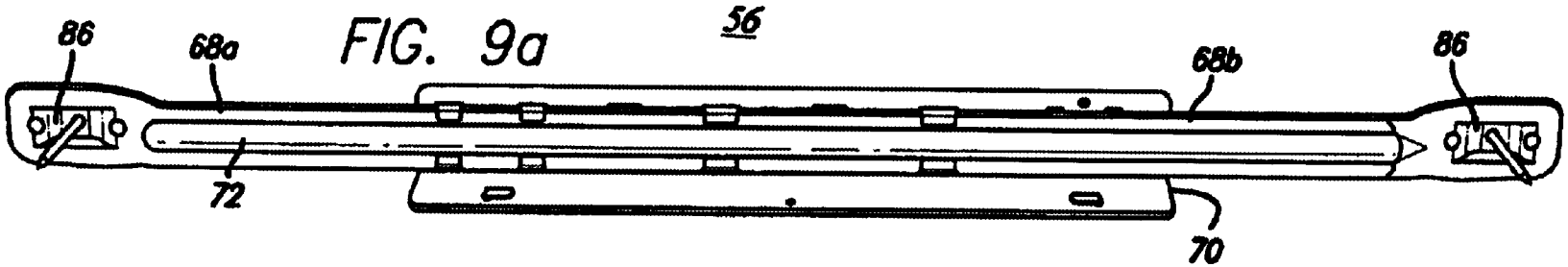
FIG. 9*a* is a perspective front view of the linear elements and mid-bracket of the boot hanger arm.
Figure 9B:
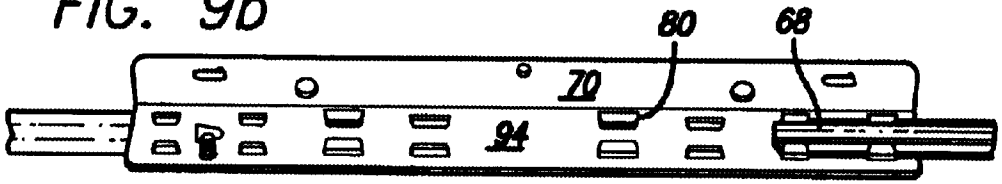
FIG. 9*b* is a perspective rear view of the mid-bracket of the boot hanger arm.
Figure 10A:
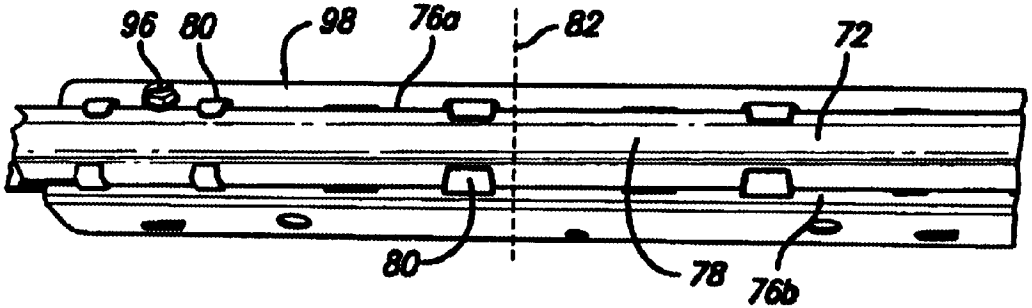
FIG. 10*a* is a perspective front view of the mid-bracket of the boot hanger arm showing the engaging elements and front surface of a first linear element in engagement with the mid-bracket.
Figure 10B:
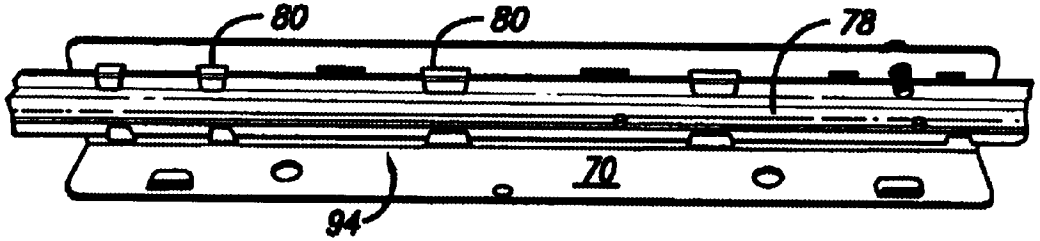
FIG. 10*b* is a perspective rear view of the mid-bracket of the boot hanger arm showing the engaging elements and front of a second linear element in engagement with the mid-bracket.
Figure 12A:
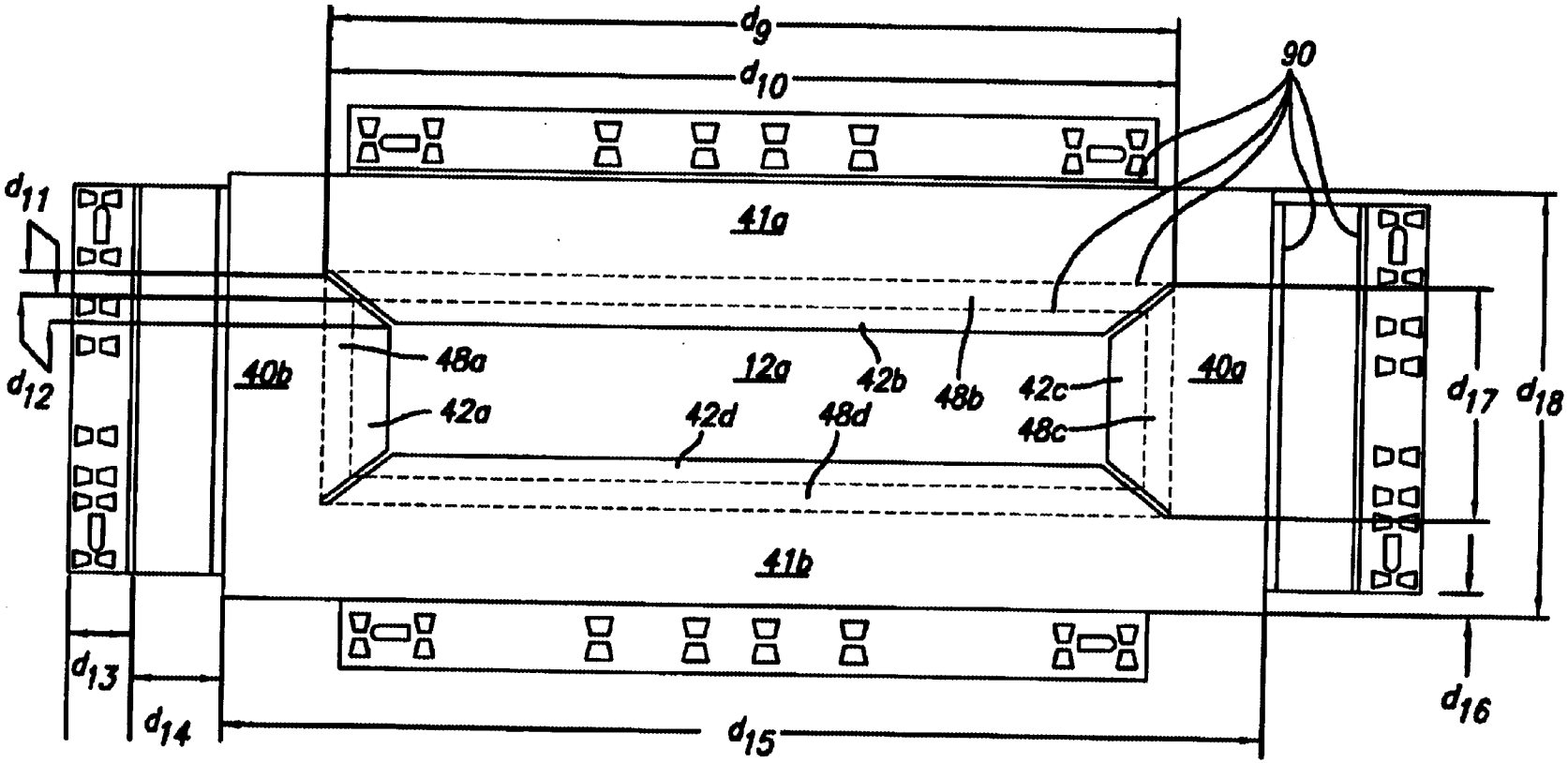
FIG. 12*a* is a top exploded view of the boot hanger frame portion and support member portion for a second embodiment of the invention.
Figures 12B, 12C, 12D, 12E, 12F, 12G:
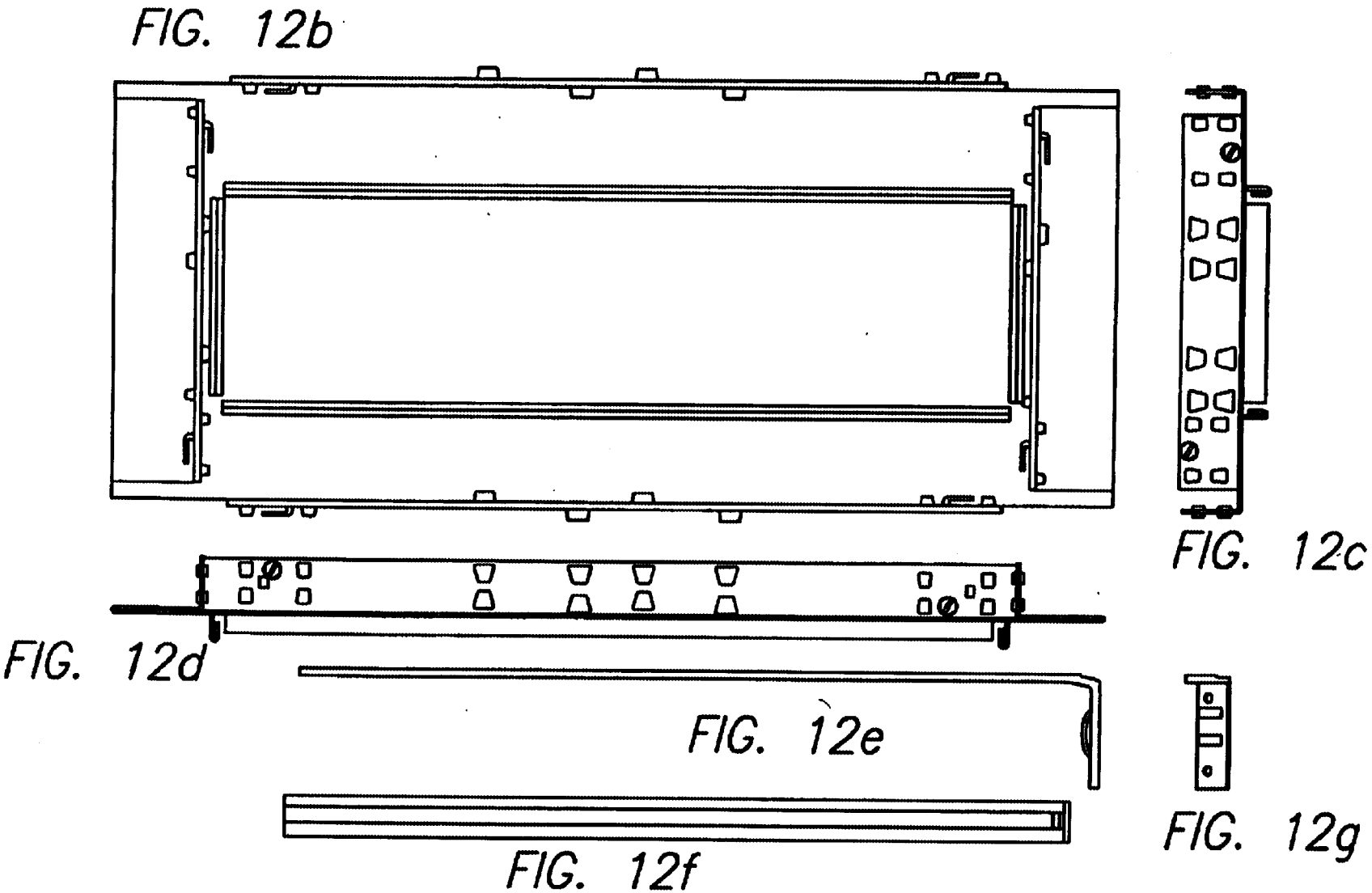
FIG. 12*b* is a top plan view of the boot hanger frame portion and support member portion for a second embodiment of the invention.
FIG. 12*c* is a side view of the boot hanger arm engaged with the flange of the boot hanger frame portion for a second embodiment of the invention.
FIG. 12*d* is a side view of the boot hanger arm for a second embodiment of the invention.
FIG. 12*e* is a side plan view of the linear element of the boot hanger arm for a second is embodiment of the invention.
FIG. 12*f* is a rear plan view of the back surface of the linear element of the boot hanger arm for a second embodiment of the invention.
FIG. 12*g* is a rear plan view of the distal end of the linear element of the boot hanger arm for a second embodiment of the invention.
Figure 13A:
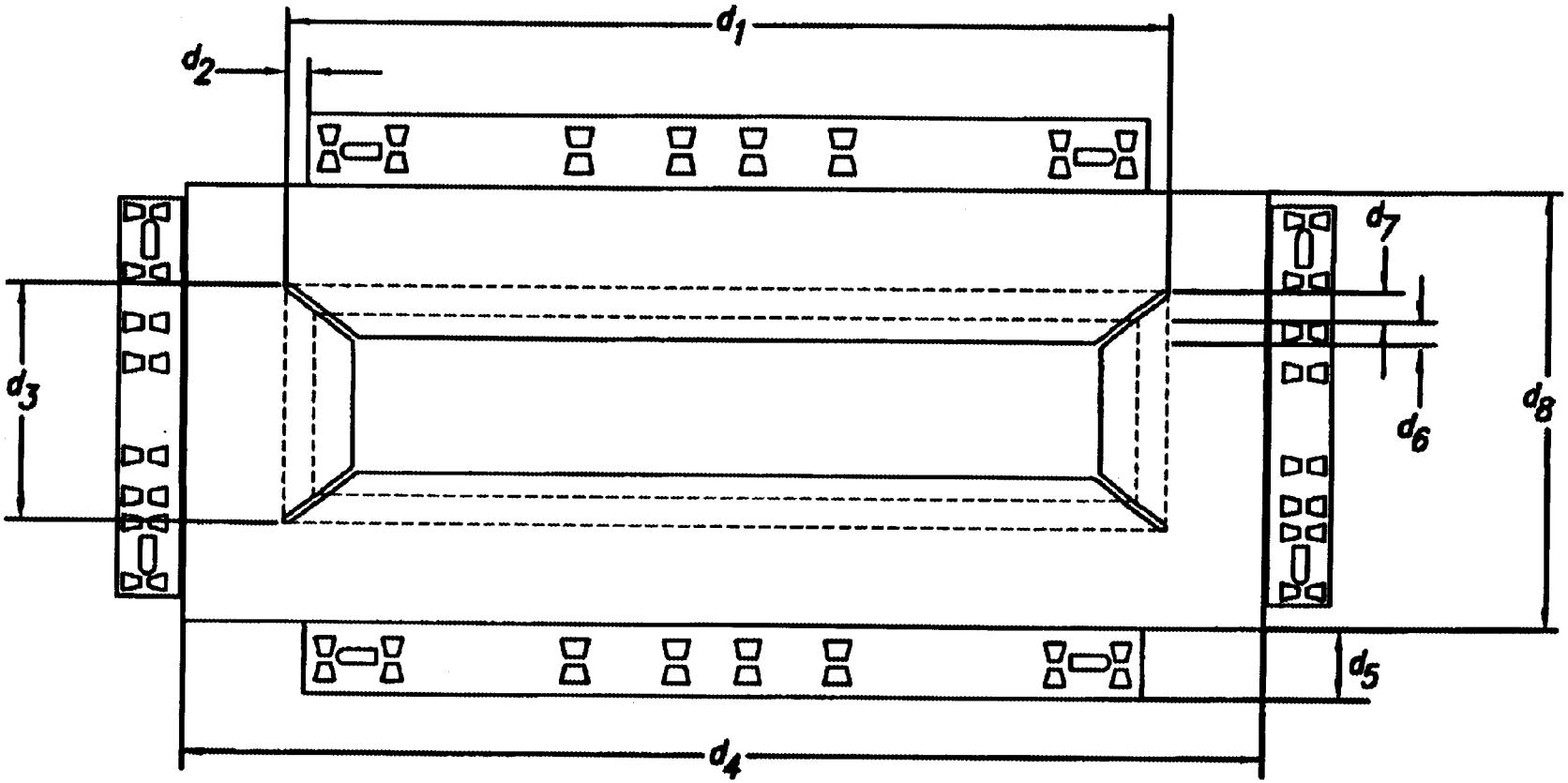
FIG. 13*a* is a top exploded view of the boot hanger frame portion and support member portion for a third embodiment of the invention.
Figure 13C:
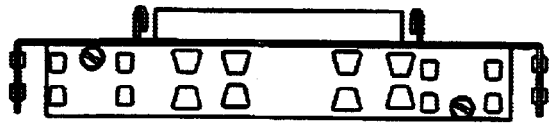
FIG. 13*c* is a side view of the boot hanger arm engaged with the flange of the boot hanger frame portion for a third embodiment of the invention.
Figure 13G:
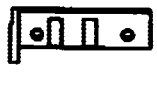
FIG. 13*g* is a rear plan view of the distal end of the linear element of the boot hanger arm for a third embodiment of the invention.
Figure 13B:
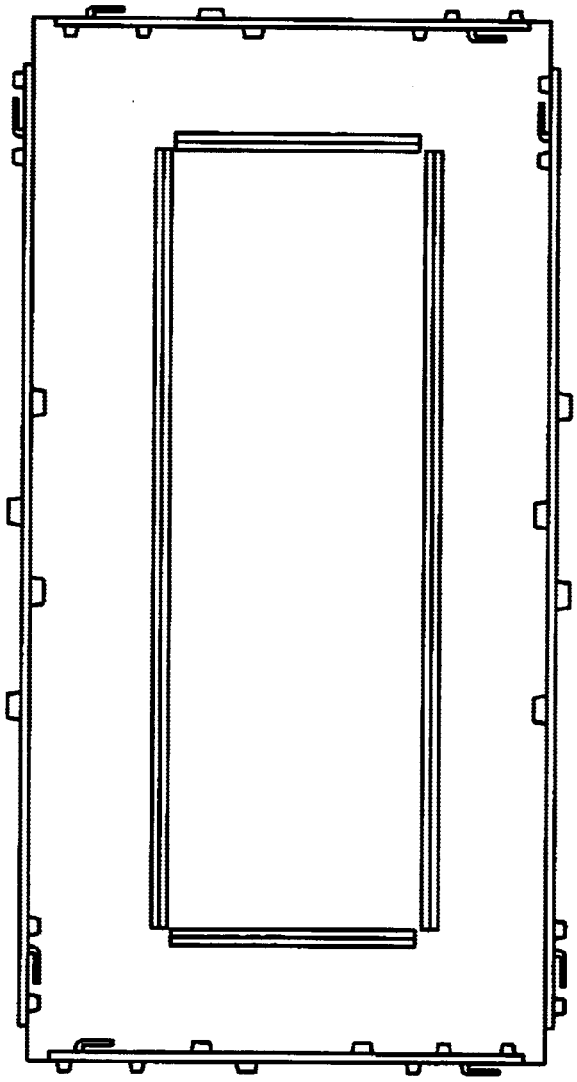
FIG. 13*b* is a top plan view of the boot hanger frame portion and support member portion for a third embodiment of the invention.
Figure 13D:
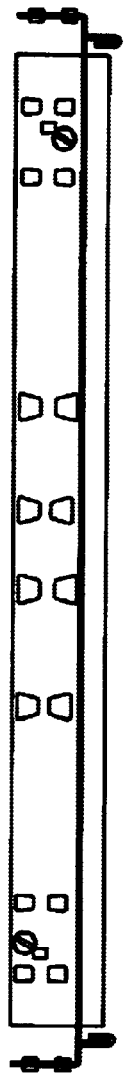
FIG. 13*d* is a side view of the boot hanger arm for a third embodiment of the invention.
Figure 13E:
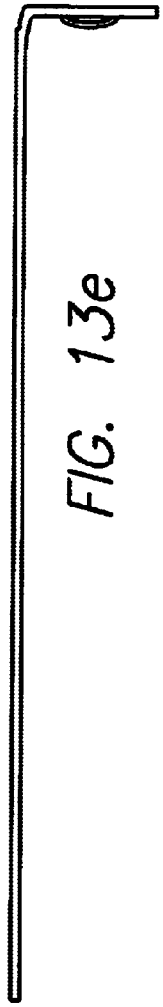
FIG. 13*e* is a side plan view of the linear element of the boot hanger arm for a third embodiment of the invention.
Figure 13F:
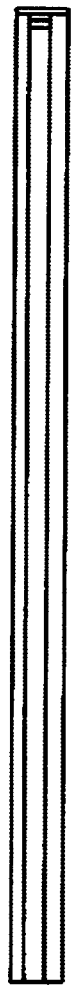
FIG. 13*f* is a rear plan view of the back surface of the linear element of the boot hanger arm for a third embodiment of the invention.

FIG. 1 shows the configured boot hanger mounting assembly 4 attached to spaced apart ceiling joists 58 of a building structure by boot hanger arms 56. The boot hanger arms 56 are attached to the ceiling joists 58 by a securing member 66 such as staples, screws or nails. The boot hanger arm 56 may be comprised of two identical linear elements 68*a*, 68*b* and a mid-bracket 70 (FIGS. 9*a*, 10*b*). The linear elements 68*a*, 68*b* have a front surface 72 and lengthwise edges 76*a*, 76*b* (FIGS. 9–10). Each linear element 68 may also comprise an outwardly projecting bump or ridge 78 running lengthwise along its front surface 72 (FIG. 10*a*). The two linear elements 68*a*, 68*b* preferably interface with the mid-bracket 70 so that they are in sliding engagement with each other and with the mid-bracket 70 (FIG. 9*a*). The mid-bracket 70 preferably comprises a plurality of engaging means 80 such as tabs, hooks or grooves on its front and back surfaces (FIGS. 9*b*, 10*a*). The plurality of engaging means 80 may be arranged in two parallel lines along the length of the mid-bracket 70 on its front and back 94 surface. The engaging means 80 preferably receive the edges of the linear element 68 while permitting it to move laterally in a sliding manner towards and away from the midpoint 82 of the mid-bracket 70. The configuration of the linear elements 68*a*, 68*b* and mid-bracket 70 permit adjustment of the boot hanger arm 56 to fit the particular dimensions of the ductwork and structure, such as the distance between ceiling joists 58. Once adjusted, the configuration of the boot hanger arm 56 may be secured via a securing member 96 such as a screw and hole assembly that tightens to secure an edge of at least one of the linear elements 68 and prevents it from further sliding or movement (FIGS. 10*a*, 10*b*). The boot hanger arm 56 may then be secured to parallel sides of the boot hanger frame portion 8 in order to secure the ductwork component 2-boot hanger mounting bracket assembly 4 to the ceiling joists 58 or other part of the structure. For example, the boot hanger arms 56 may be fit beneath the lip portion 50 of the support member portion 6 and secured to the boot hanger frame portion 8 and support member portion 6 by a securing material 84 such as button punches, rivets, spot welds or epoxy. The linear elements 68 of each boot hanger arm 56 preferably comprise a hole 86 at their distal ends 88 (FIG. 9*a*) so that the boot hanger arm 56 may be secured to the ceiling joists 58 or other part of the structure by a securing member 66, such as nails or screws.

Once the boot hanger mounting bracket 4-ductwork component 2 assembly has been secured to the structure, an airflow control means 36 such as a grille louver or register may be fit to the opening defined by the configured boot hanger mounting bracket assembly 4. The airflow control means 36 may then be attached to the ceiling lid 60 or other part of the structure by a securing member such as threaded screws. The airflow control means 36 will generally comprise sidewalls forming a passageway directing airflow from the duct through the register, as well as adjustable louvers for controlling the airflow. The louvers may be selectively rotatable by the user to control the direction and volume of airflow, including blocking the passageway. The perimeter of the air flow control means 36 preferably extend beyond the duct opening to abut against the ceiling lid 60 floor or wall on opposite sides of the duct opening to prevent gaps and to provide aesthetic appearance.

While the present invention has been described with regards to particular embodiments, it is recognized that additional variations of the present invention may be devised without departing from the inventive concepts. Additionally, the following Examples are presented to further illustrate preferred embodiments of the invention but are not intended to limit the present invention.

EXAMPLE I

DIMENSIONS OF FIRST EMBODIMENT OF SUPPORT MEMBER AND BOOT HANGER FRAME PORTION FOR BOOT RANGER MOUNTING BRACKET ASSEMBLY

| Dimension (see FIG. 20) | Approx. Measurement in cm (width × length) |
|---|---|
| parallel strips 24 forming boot hanger frame portion width | 2.5 × 15.0 |

EXAMPLE I-continued

DIMENSIONS OF FIRST EMBODIMENT OF SUPPORT MEMBER AND BOOT HANGER FRAME PORTION FOR BOOT RANGER MOUNTING BRACKET ASSEMBLY

| Dimension (see FIG. 20) | Approx. Measurement in cm (width × length) |
|---|---|
| rearward facing flange 16 along width of boot hanger frame portion | 2.5 × 12.5 |
| parallel strips 26 forming boot hanger frame portion length | 2.5 × 36.0 |
| rearward facing flange 18 along length of boot hanger frame portion | 2.5 × 33.0 |
| Overlap portion 38 | 2.5 × 2.5 |
| Opening 12 in boot hanger frame portion-bracket assembly | 10.0 × 35.0 |
| Boot hanger support member portion 6 | 9.5 × 29.5 |
| Inner tab 42 | 1.0 |
| Outer tab 48 | 2.0 to 2.5 |
| Pocket 46 | 0.1 to 0.25 |
| Lip portion 50 | 1.0 to 1.5 × 9.0 |

EXAMPLE II

DIMENSIONS OF SECOND EMBODIMENT OF SUPPORT MEMBER AND BOOT HANGER FRAME PORTION FOR BOOT HANGER MOUNTING BRACKET ASSEMBLY (Configuration illustrated in FIGS. 13a–13g)

| Dimension (see FIG. 20) | Approx. Measurement in cm |
|---|---|
| $d_1$ | 35.6 |
| $d_2$ | 0.95 |
| $d_3$ | 5.7, 10.2 or 15.2 |
| $d_4$ | 20.3, 25.4 or 30.5 |
| $d_5$ | 2.54 |
| $d_6$ | 1.27 |
| $d_7$ | 1.27 |
| $d_8$ | 20.3 |

EXAMPLE III

DIMENSIONS OF THIRD EMBODIMENT OF SUPPORT MEMBER AND BOOT HANGER FRAME PORTION FOR BOOT HANGER MOUNTING BRACKET ASSEMBLY (Configuration illustrated in FIGS. 12a–12g)

| Dimension (see FIG. 21) | Approx. Measurement in cm |
|---|---|
| $d_9$ | 25.4, 30.5 or 35.6 |
| $d_{10}$ | 33.6 |
| $d_{11}$ | 1.27 |
| $d_{12}$ | 1.27 |
| $d_{13}$ | 2.54 |
| $d_{14}$ | 3.81 |
| $d_{15}$ | 43.2 |
| $d_{16}$ | 0.95 |
| $d_{17}$ | 5.7, 10.2 or 15.2 |
| $d_{18}$ | 20.3 |

What is claimed is:

1. An apparatus for mounting ductwork of heating, cooling and ventilation systems in a building structure having an interior, comprising:

a hanger frame portion defining an opening, wherein the hanger frame portion comprises at least a first rearward projecting flange and a second rearward projecting flange disposed in parallel relation to one another;

a support member portion defining an opening and comprising at least one pocket, wherein the hanger frame portion is arranged concentrically and secured about the support member portion;

at least one hanger arm attached to at least one of first and second rearward projecting flanges of the hanger frame portion and to the building structure;

at least one ductwork component having edges; and an airflow control means facing into the interior of the building structure; wherein the pocket is configured to receive the edges of the ductwork component and wherein the opening defined by the support member portion is configured to receive a portion of the airflow control means.

2. An apparatus for mounting ductwork of heating, cooling and ventilation systems in a building structure having an interior, comprising:

a hanger frame portion defining an opening, wherein the hanger frame portion comprises at least a first rearward flange and a second rearward flange disposed in parallel relation to one another;

a support member portion defining an opening and comprising at least one pair of parallel sidewalls defining at least one pocket, wherein the hanger frame portion is arranged concentrically and secured about the support member portion;

at least one hanger arm attached to the hanger frame portion and to the building structure;

at least one ductwork component having edges; and an airflow control means facing into the interior of the building structure; wherein the pocket is configured to receive the edges of the ductwork component and wherein the opening defined by the support member portion is configured to receive a portion of the airflow control means.

3. The apparatus of claim 2, wherein at least a portion of at least one of the parallel sidewalls is configured at an approximately right angle to the parallel sidewall to form a lip portion.

4. The apparatus of claim 3, wherein the lip portion is secured to the hanger frame by a securing material.

5. The apparatus of claim 4, wherein the securing material is selected from the group consisting of button punches, spot welds, epoxy, rivets and staples.

6. The apparatus of claim 2, wherein the hanger fame portion and support member portion comprise a first flattened position and a second configured position, and wherein the hanger frame portion and support member portion may be transported to the building structure in the first position and configured in the second position at the building structure to form a boot hanger mounting bracket.

7. The apparatus of claim 2, wherein the hanger frame portion and support member portion are formed from at least one flat sheet of material.

8. The apparatus of claim 2, wherein the hanger frame portion and support member portion comprise a material selected from the group consisting of galvanized metals, aluminum, steel, high impact polystyrene and resins.

9. The apparatus of claim 2, wherein a portion of the hanger arm is attached to a support structure of the building.

10. The apparatus of claim 9, wherein the support structure is a structure selected from the group consisting of ceiling joists, floor supports and wall studs.

11. The apparatus of claim 2, wherein the hanger arm comprises a bracket including a midpoint and at least one linear element including a distal end and a proximal end.

12. The apparatus of claim 11, wherein the linear element is in sliding engagement with the bracket, and whereby a distance between the distal end of the linear element and the midpoint of the bracket may be adjusted by sliding the linear element towards or away from the midpoint of the bracket.

13. The apparatus of claim 12, further comprising a securing member having a first position and a second position, and whereby the liner element is permitted to move in sliding engagement with the bracket in the first position, and whereby movement of the linear element is prevented when the securing member is in the second position so that a distance between the distal end of the linear element and the midpoint of the bracket is maintained.

14. The apparatus of claim 13, wherein the linear element is slidingly moved in the securing member first position to a distance configured to permit attachment of the hanger arm to a building support structure, and wherein the securing member is subsequently placed in the second position to prevent further movement of the linear element after configuration.

15. An apparatus for mounting ductwork of heating, cooling and ventilation systems in a building having an interior, comprising:

at least one ductwork component having at least one edge;

a hanger frame portion comprising two pairs of parallel sides and defining an opening;

a support member portion configured to support the ductwork component and comprising at least one pocket and having an outer perimeter and an inner perimeter defining an opening; wherein the hanger frame portion is arranged concentrically about the support member portion to form a boot hanger mounting bracket and wherein the edge of the ductwork component fits into the pocket in the support member portion;

at least one hanger arm comprising a midbracket and at least two linear elements each including a distal end and a proximal end, wherein the linear elements are configured to be in sliding engagement with the midbracket, and wherein the distal ends of the linear elements are attached to the building structure, and wherein the midbracket is attached to the hanger frame; and an airflow control means facing into the interior of the building structure; wherein the opening defined by the inner perimeter of the support member portion is configured to receive a portion of the airflow control means.

16. A method for mounting ductwork of heating, cooling and ventilation systems in a building structure having a building duct shaft and at least one building support structure and a building interior comprising:

providing at least one pre-fabricated ductwork component having at least one edge;

providing a support member portion comprising an outer and an inner perimeter defining an opening and comprising at least one support member pocket;

providing a hanger frame portion comprising two sets of parallel sides defining an opening;

providing at least one hanger arm comprising a midbracket and at least two linear element each including a distal end and a proximal end, wherein the linear elements and midbracket are in sliding engagement with one another;

slidably adjusting the liner elements so that hanger arm is configured to attach to at least one building support structure;

securing the linear elements to maintain configuration of the hanger arms;

securing the distal end of the linear elements of the hanger arm to the building support structures;

configuring the hanger frame and support member to form a boot hanger mounting bracket assembly having a distal end and a proximal end;

fitting the edge of the pre-fabricated ductwork component into the support member pocket;

configuring the boot hanger mounting bracket assembly, hanger arms and ductwork component in the building duct shaft;

securing the hanger arm midbracket to the hanger frame of the boot hanger mounting bracket assembly;

arranging a portion of the air flow control means to fit within the opening defined by the proximal end of the boot hanger mounting bracket assembly; and securing the airflow control means over the opening defined by the boot hanger mounting bracket assembly.

17. The method of claim 16, wherein the linear elements are slidingly configured to an overall hanger arm length, and wherein the overall hanger arm length permits attachment of the hanger arm to the building support structures, and wherein the securing member prevents further movement of the linear element after configuration.

18. The method of claim 16 wherein the support member portion comprises a lip portion configured at an approximately right angle to a sidewall forming the pocket of the support member portion, and wherein the lip portion of the support member portion is secured to the hanger frame.

* * * * *